US005539281A

United States Patent [19]

Shackle et al.

[11] Patent Number: 5,539,281

[45] Date of Patent: Jul. 23, 1996

[54] EXTERNALLY DIMMABLE ELECTRONIC BALLAST

[75] Inventors: Peter W. Shackle, Arlington Heights; Randy G. Russell, Glen Ellyn; Kent E. Crouse, Hanover Park; Ronald J. Bezdon, Antioch, all of Ill.

[73] Assignee: Energy Savings, Inc., Schaumburg, Ill.

[21] Appl. No.: 376,774

[22] Filed: Jan. 23, 1995

Related U.S. Application Data

[63] Continuation-in-part of Ser. No. 266,746, Jun. 28, 1994, Pat. No. 5,396,155.

[51] Int. Cl.[6] ..... H05B 37/02

[52] U.S. Cl. ..... 315/224; 315/209 R; 315/307; 315/247; 315/DIG. 4; 315/DIG. 7

[58] Field of Search ..... 315/291, 224, 315/244, 247, 209 R, 276, 307, 314, 205, 193, 227 R, 225, DIG. 2, DIG. 4, DIG. 7

[56] References Cited

U.S. PATENT DOCUMENTS

| | | | |
|---|---|---|---|
| 3,514,668 | 5/1970 | Johnson et al. | 315/205 |
| 4,017,785 | 4/1977 | Perper | 321/4 |
| 4,207,498 | 6/1980 | Spira et al. | 315/97 |
| 4,220,896 | 9/1980 | Paice | 315/205 |
| 4,251,752 | 2/1981 | Stolz | 315/DIG. 7 X |
| 4,370,600 | 1/1983 | Zansky | 315/244 |
| 4,562,383 | 12/1985 | Kirscher et al. | 315/225 |
| 4,677,345 | 6/1987 | Nilssen | 315/209 R |
| 4,700,113 | 10/1987 | Stupp | 315/224 |
| 4,709,188 | 11/1987 | Roberts | 315/DIG. 7 X |
| 4,728,866 | 3/1988 | Capewell et al. | 315/224 |
| 4,866,350 | 9/1989 | Counts | 315/209 R |
| 5,083,255 | 1/1992 | Nilssen | 363/132 |
| 5,084,653 | 1/1992 | Nilssen | 315/DIG. 7 X |
| 5,172,033 | 12/1992 | Smits | 315/224 |
| 5,173,643 | 12/1992 | Sullivan et al. | 315/276 |
| 5,214,355 | 5/1985 | Nilssen | 315/219 |
| 5,315,214 | 5/1994 | Lesea | 315/291 X |
| 5,371,439 | 12/1994 | Griffin | 315/209 R |
| 5,461,287 | 10/1995 | Russell et al. | 315/209 R |

*Primary Examiner*—Robert Pascal
*Assistant Examiner*—Haissa Philogene
*Attorney, Agent, or Firm*—Cahill, Sutton & Thomas

[57] ABSTRACT

An electronic ballast includes a converter coupled to a variable frequency inverter and a series resonant, parallel loaded output coupled to the inverter. The frequency of the inverter increases when the supply voltage from the converter decreases. The converter includes a full wave rectifier producing a first voltage and an unregulated boost circuit producing a second voltage which is combined with the first voltage to produce the supply voltage. The amount of boost, and therefore the magnitude of the supply voltage, is varied to provide dimming. Dimming is controlled mechanically, via a potentiometer, or electrically, via a control input. Dimming also occurs in response to changes in the first voltage, i.e. from changes in the voltage on an AC power line or from changes in the voltage provided by a capacitive dimmer coupled between the ballast and an AC power line.

9 Claims, 3 Drawing Sheets

EXTERNALLY DIMMABLE ELECTRONIC BALLAST

CROSS-REFERENCE TO RELATED PATENT

This is a continuation-in-part of Ser. No. 08/266,746 filed Jun. 28, 1994, now U.S. Pat. No. 5,396,155.

BACKGROUND OF THE INVENTION

This invention relates to electronic ballasts for gas discharge lamps and, in particular, to an electronic ballast which can be dimmed by an external dimmer such as used with incandescent lamps.

A gas discharge lamp, such as a fluorescent lamp, is a non-linear load to a power line, i.e. the current through the lamp is not directly proportional to the voltage across the lamp. Current through the lamp is zero until a minimum voltage is reached, then the lamp begins to conduct. Once the lamp conducts, the current will increase rapidly unless there is a ballast in series with the lamp to limit current.

Because of the non-linear characteristics of a gas discharge lamp, dimming has long been a problem and many solutions have been proposed. Most dimmers include complicated circuitry and all dimmers require external access to the ballast, e.g. by wire connecting the ballast to a dedicated control circuit, a knob on a control shaft extending from the ballast, or optical sensors electrically coupled to the ballast. Until now, gas discharge lamps could not be controlled by dimmers intended for incandescent lamps, e.g. diodes, triacs, or variacs.

The simplest dimmer for an incandescent lamp is a diode in series with the lamp. The diode cuts off the positive portion or the negative portion of the A.C. waveform, thereby reducing the power applied to the lamp. Only two light levels are available with a diode, dim and bright. A triac dimmer uses switching circuitry to cut off an adjustable portion of the A.C. waveform to change the power delivered to a lamp. A variac is a variable transformer which reduces the voltage to a lamp for a range of light levels. A variac differs from a triac in that the output voltage from a variac is sinusoidal. Since many electronic ballasts require a sinusoidal line voltage in order to operate, a variac may seem a likely candidate for dimming a gas discharge lamp driven by an electronic ballast.

A variac is large, heavy, and expensive and not used for dimming lighting in residential or commercial applications. Dimmers must be more compact, lighter, and less expensive than variacs. Typical dimmers use one or more semiconductor switches to block a portion of the line voltage. Dimmers can be divided between those which block the initial portion of the AC cycle and those which block the terminal portion of the AC cycle.

The AC line voltage has a sinusoidal waveform and crosses zero volts twice per cycle. A triac dimmer blocks the line voltage from the zero crossing to some predetermined time after zero crossing, then passes the line voltage. The delay is usually expressed in degrees and, if the delay is 90°, a triac is turned on at the peak voltage of the power line, e.g. 170 volts for a 120 volt power line. Many electronic devices, such as ballasts, have capacitive inputs. Switching on at or near the peak line voltage produces a large in-rush of current to such devices, causing a significant and undesirable amount of electrical and acoustical noise.

Dimmers which block the terminal portion of the AC cycle are known as "soft" dimmers, or "quiet" dimmers, or "electronic" dimmers, or "capacitive" dimmers. The latter term shall be used herein. Capacitive dimmers typically include field effect transistors and a zero crossing detector. The transistors are turned on at each zero crossing and turned off at a predetermined point each half cycle to vary the average power supplied to a load. Many commercially available capacitive dimmers are based upon the T5555 zero crossing detector sold by SGS-Thompson Microelectronics.

The simplest ballast for a gas discharge lamp is a resistor in series with the lamp but the resistor consumes power, thereby decreasing efficiency of the lighting system, measured in lumens per watt. A "magnetic" ballast is an inductor in series with the lamp and is more efficient than a resistor but is physically large and heavy. A large inductor is required because impedance is a function of frequency and power lines operate at low frequency (50–60 hz.)

An electronic ballast typically includes a converter for changing the alternating current (AC) from a power line to direct current (DC) and an inverter for changing the direct current to alternating current at high frequency, typically 25–60 khz. Since a frequency much higher than 50–60 hz. is used, the inductors in an electronic ballast can be much smaller than the inductors for a magnetic ballast.

Converting from alternating current to direct current is usually done with a full wave or bridge rectifier. A filter capacitor on the output of the rectifier stores energy for powering the inverter. The voltage on the capacitor is not constant but has a 120 hz "ripple" that is more or less pronounced depending on the size of the capacitor and the amount of current drawn from the capacitor.

Some ballasts include a boost circuit between the rectifier and the filter capacitor in the converter. As used herein, a "boost" circuit is a circuit which increases the DC voltage, e.g. from approximately 170 volts (assuming a 120 volt line voltage) to 300 volts or more for operating a lamp, and which may provide power factor correction. "Power factor" is a figure of merit indicating whether or not a load in an AC circuit is equivalent to a pure resistance, i.e. indicating whether or not the voltage and current are sinusoidal and in phase. It is preferred that the load be the equivalent of a pure resistance (a power factor equal to one). Electronic ballasts have a significant advantage over magnetic ballasts because a magnetic ballast has a poor power factor.

Most electronic ballasts sold today do not dim properly, if at all, in response to a reduced line voltage. A gas discharge lamp is essentially a constant voltage load on a ballast and, if lamp current decreases, the voltage across the lamp increases slightly. Consequently, most electronic ballasts stop working abruptly when the line voltage is reduced below a certain level. Thus, a variac cannot be used to dim gas discharge lamps driven by most electronic ballasts.

Some regulated electronic ballasts operate a lamp at constant power by drawing more current at reduced line voltages. Electrical utilities often control power distribution on a grid with "brown-outs" in which the line voltage is reduced by up to ten percent in some or all of the grid. Regulated power supplies, including ballasts, not only interfere with a utility's ability to control power consumption but make the problem worse by drawing even more current at reduced voltage in order to maintain constant power to a load; e.g. U.S. Pat. No. 4,220,896 (Paice). Unfortunately, the alternative has been to let gas discharge lamps flicker or go out. It is desired that an electronic ballast dim in response to reduced line voltage, thereby helping utilities to achieve their intended purpose with brown-outs.

There are many types of electronic ballasts and a preferred embodiment of this invention includes what is known as a series resonant, parallel loaded inverter. Such inverters avoid the necessity of an output transformer by coupling a lamp in parallel with the capacitor of a series resonant inductor and capacitor. The inverter typically oscillates at a frequency slightly higher than the resonant frequency of the inductor and capacitor and dimming is achieved by raising the frequency of the inverter. The resonant output provides a sinusoidal voltage for the lamp.

It is a characteristic of series resonant, parallel loaded inverters of the prior art that the frequency of the inverter decreases as the line voltage decreases. For example, U.S. Pat. No. 4,677,345 (Nilssen) describes a series resonant, parallel loaded inverter including a "half bridge," i.e. series connected switching transistors. A saturable reactor is connected in the base-emitter circuit of each transistor for switching the transistors at a frequency determined by the saturation time of the reactors. If the line voltage decreases, the reactors saturate more slowly and the frequency of the inverter decreases. As the frequency decreases, the series inductor presents less impedance and prevents lamp current from decreasing in proportion to line voltage. Thus, output power is relatively insensitive to line voltage.

In view of the foregoing, it is therefore an object of the invention to provide an electronic ballast which can be controlled by a capacitive dimmer connected between the ballast and a power line.

A further object of the invention is to provide an electronic ballast having a converter and an inverter which reduces power to a gas discharge lamp in response to reduced voltage from the converter.

Another object of the invention is to provide an electronic power supply including an inverter which provides less power in response to a reduced supply voltage independently of the voltage applied to the power supply.

A further object of the invention is to provide an electronic ballast for gas discharge lamps which can be on the same branch circuit as incandescent lamps and controlled by a single dimmer.

Another object of the invention is to provide an inverter in which the frequency of the output current increases as the voltage supplied to the inverter decreases.

A further object of the invention is to provide a series resonant, parallel loaded inverter in which the frequency of the inverter is approximately inversely proportional to the supply voltage.

Another object of the invention is to provide an electronic ballast which can be dimmed by varying the output voltage from a boost circuit in the ballast.

SUMMARY OF THE INVENTION

The foregoing objects are achieved in the invention in which an electronic ballast includes a converter coupled to a variable frequency inverter and a series resonant, parallel loaded output coupled to the inverter. The frequency of the inverter increases when the supply voltage from the converter decreases. The converter includes a full wave rectifier producing a first voltage and an unregulated boost circuit producing a second voltage which is combined with the first voltage to produce the supply voltage.

Dimming occurs in response to changes in the first voltage or in response to changes in the second voltage. The magnitude of the second voltage is controlled mechanically, via a potentiometer electrically connected to the converter, or electrically, via a control input to the converter. The potentiometer can be physically located outside of the ballast. The control input is connected by wire or infra-red link to a suitable control signal from apparatus separate from the ballast. The magnitude of the first voltage follows changes in the AC line voltage caused by power line fluctuations or caused by a capacitive dimmer connected between the power line and the ballast. The unique dimming ability enables the ballast to be on the same branch circuit as incandescent lamps and controlled by a common dimmer.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
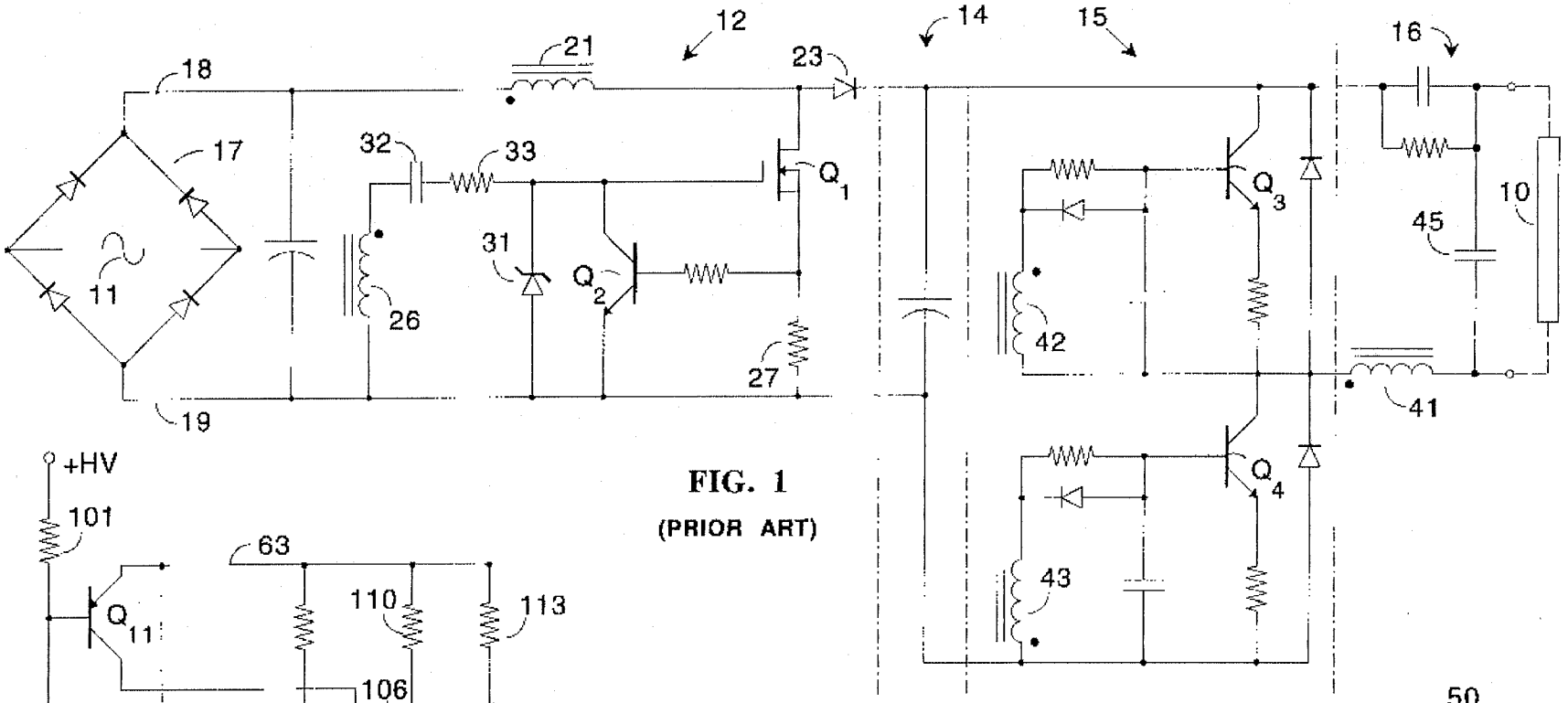
FIG. 1 (PRIOR ART)
FIG. 1 is a schematic of an electronic ballast of the prior art.

FIG. 1 illustrates the major components of an electronic ballast for connecting fluorescent lamp 10 to an AC power line, represented by waveform 11. FIG. 1 is an inoperative simplification that is representative of, but not the same as, such prior art as U.S. Pat. No. 4,562,383 (Kirscher et al.) and U.S. Pat. No. 5,214,355 (Nilssen). The electronic ballast in FIG. 1 includes converter 12, energy storage capacitor 14, inverter 15, and output 16. Converter 12 rectifies the alternating current from the AC power line and stores it on capacitor 14. Inverter 15 is powered by the energy stored in capacitor 14 and provides a high frequency, e.g. 30 khz, alternating current through output 16 to lamp 10.

Converter 12 includes bridge rectifier 17 having DC output terminals connected to rails 18 and 19. If rectifier 17 were simply connected to capacitor 14, then the maximum voltage on capacitor 14 would be approximately equal to the peak of the applied voltage. The voltage on capacitor 14 is increased to a higher voltage by a boost circuit including inductor 21, transistor $Q_1$, and diode 23. When transistor $Q_1$ is conducting, current flows from rail 18 through inductor 21 and transistor $Q_1$ to rail 19. When transistor $Q_1$ stops conducting, the field in inductor 21 collapses and the inductor produces a high voltage pulse which adds to the voltage from bridge rectifier 17 and is coupled through diode 23 to capacitor 14. Diode 23 prevents current from flowing back to transistor $Q_1$ from capacitor 14.

A pulse signal must be provided to the gate of transistor $Q_1$ in order to periodically turn $Q_1$ on and off to charge capacitor 14. Inductor 26 is magnetically coupled to inductor 21 and provides feedback to the gate of transistor $Q_1$, causing transistor $Q_1$ to oscillate at high frequency, i.e. a frequency at least ten times the frequency of the AC power line, e.g. 30 khz. The source of an initial pulse signal is not shown in FIG. 1.

A boost circuit and an inverter can each be self-oscillating, triggered, or driven. In addition, each can have a variable frequency or a fixed frequency. The circuit in FIG. 1 is simplified to illustrate the basic combination of converter and inverter. As illustrated in FIG. 1, the boost circuit is a variable frequency boost, unlike the boost circuits shown in the Kirscher et al. and Nilssen patents. Switch-mode power supplies use variable frequency boost circuits and typically exhibit high harmonic distortion. Resistor 27 causes the boost circuit of FIG. 1 to have a variable frequency.

Resistor 27, in series with the source-drain path of transistor $Q_1$, provides a feedback voltage which is coupled to the base of transistor $Q_2$. When the voltage on resistor 27 reaches a predetermined magnitude, transistor $Q_2$ turns on, turning off transistor $Q_1$. Zener diode 31 limits the voltage on the gate of transistor $Q_1$ from inductor 26 and capacitor 32 and resistor 33 provide pulse shaping for the signal to the gate of transistor $Q_1$ from inductor 26. Since the voltage drop across resistor 27 will reach the predetermined magnitude sooner as the AC line voltage increases, more pulses per unit time will be produced by the boost, i.e. the frequency will increase. When the AC line voltage decreases, the frequency will decrease.

In inverter 15, transistors $Q_3$ and $Q_4$ are series connected between rails 18 and 19 and conduct alternately to provide a high frequency pulse train to lamp 10. Inductor 41 is series connected with lamp 10 and is magnetically coupled to inductors 42 and 43 for providing feedback to transistors $Q_3$ and $Q_4$ to alternately switch the transistors. The oscillating frequency of inverter 15 is independent of the frequency of converter 12 and is on the order of 25–50 khz. Output 16 is a series resonant LC circuit including inductor 41 and capacitor 45. Lamp 10 is coupled in parallel with resonant capacitor 45 in what is known as a series resonant, parallel coupled or direct coupled output.

If the line voltage increases, then resistor 27 turns transistor $Q_1$ off slightly sooner during each cycle of the boost circuit, thereby increasing the frequency of converter 12. As the frequency of converter 12 increases, the voltage on capacitor 14 increases. If inductors 41, 42, and 43 were saturating inductors, the increased voltage across capacitor 14 would cause the inductors to saturate slightly sooner each cycle because of the increased current. Thus, the frequency of inverter 15 would also increase with increasing line voltage.

Figure 2:
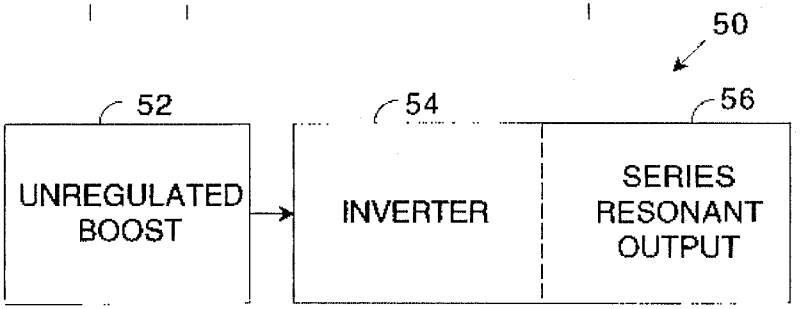
FIG. 2 is a block diagram of a ballast constructed in accordance with a preferred embodiment of the invention.

FIG. 2 is a block diagram of a ballast constructed in accordance with the invention. In FIG. 2, ballast 50 includes unregulated boost circuit 52 and inverter 54 having series resonant output 56. Boost circuit 52 takes rectified DC voltage, whether or not sinusoidal, and produces power approximately proportional to the square of the input voltage.

Boost circuit 52 is characterized by an input current that is proportional to the input voltage, i.e. boost circuit 52 can include power factor correction circuitry. The output voltage from boost circuit 52 depends upon the input impedance of inverter 54; i.e. the output voltage is unregulated and is high for a high impedance and low for a low impedance. Converter 12 (FIG. 1) and many other types of boost circuits can be used for unregulated boost 52. For example, what are known as buck circuits, buck-boost circuits, and boost circuits are suitable, whether variable frequency or constant frequency.

Inverter 54 is either a variable frequency inverter or a variable pulse width inverter and, in either case, differs from inverters of the prior art by responding oppositely to changes in supply voltage or current. Specifically, if inverter 54 is a variable frequency inverter, then the output frequency increases with decreasing supply voltage. If inverter 54 is a variable pulse width inverter, then the pulse width of the output decreases with decreasing supply voltage. A preferred embodiment of a variable frequency inverter is described in detail in conjunction with FIG. 4. A variable pulse width inverter is described in U.S. Pat. No. 5,173,643 (Sullivan et al.) and modification to the Sullivan et al. circuit is described below. Series resonant output 56 is similar to output 16 of FIG. 1. A lamp is connected in parallel with the capacitor of the series resonant circuit.

Figure 3:
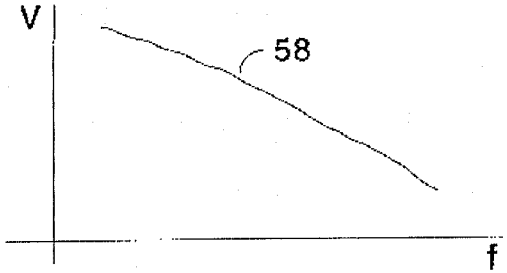
FIG. 3 is a voltage-frequency characteristic curve of a ballast constructed in accordance with the invention.

FIG. 3 illustrates the voltage/frequency characteristic of a ballast constructed in accordance with a preferred embodiment of the invention. Curve 58 shows the change in inverter frequency f with respect to line voltage V. Unlike ballasts of the prior art, the frequency of inverter 54 increases with decreasing line voltage, assuming that the ballast is operating above the resonant frequency of the series resonant circuit. This result is obtained from the control circuit in the inverter which causes the frequency of the inverter to increase with decreasing supply voltage or current.

The output voltage from inverter 54 is relatively constant but the lamp current decreases as the frequency increases. A ballast constructed in accordance with the invention will function at progressively reduced power levels as the input voltage is reduced and can operate on sinusoidal or non-sinusoidal input voltages. A non-sinusoidal input voltage from a capacitive dimmer is preferred to avoid electrical and acoustical noise.

Figure 4:
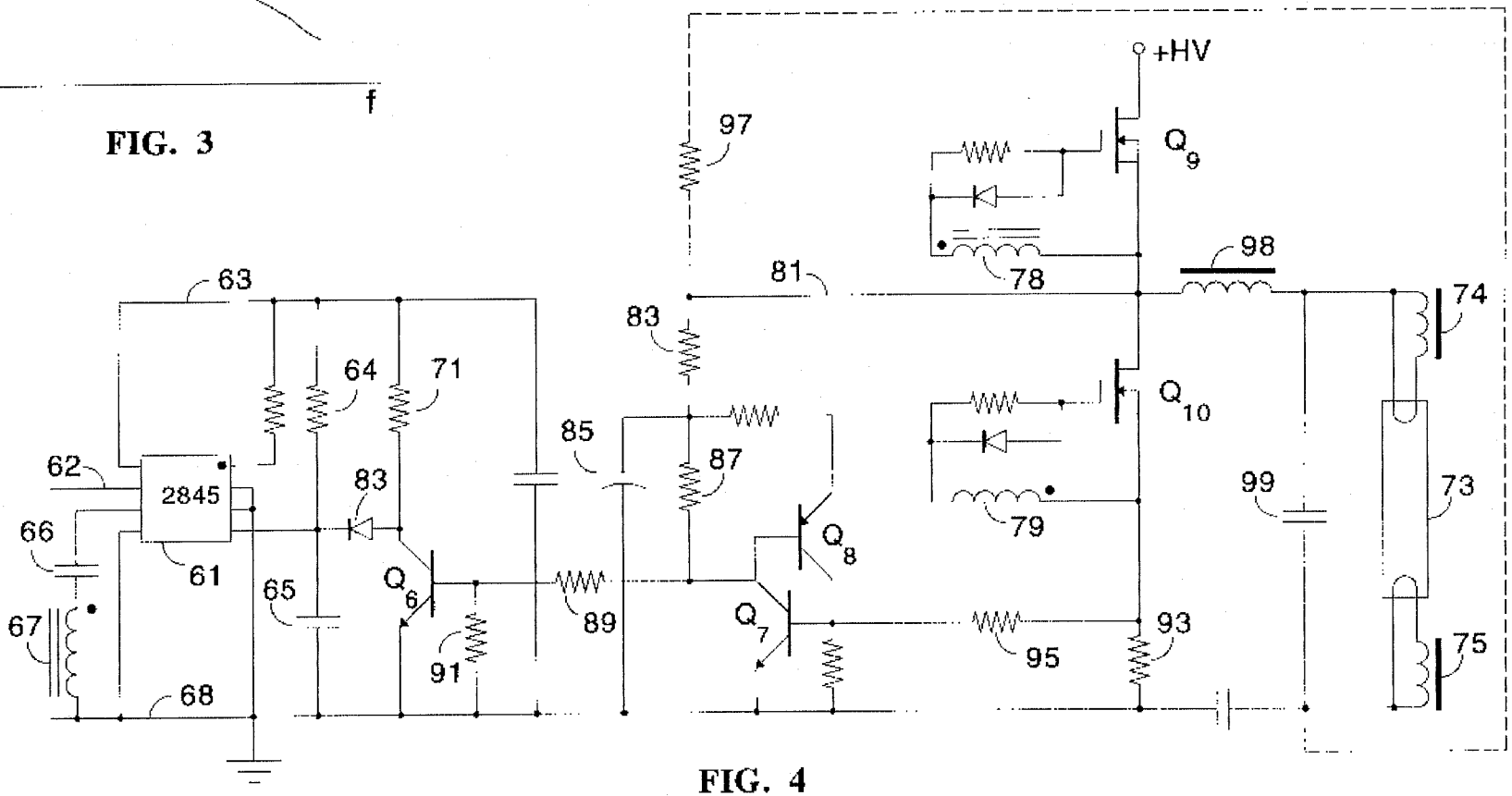
FIG. 4 is a schematic of the inverter and output of a ballast constructed in accordance with the invention.

FIG. 4 illustrates the inverter and output of a variable frequency ballast constructed in accordance with a preferred embodiment of the invention. In FIG. 4, the inverter includes a variable frequency driver circuit having frequency determining elements including a transistor acting as a variable resistor.

Driver circuit 61 is powered from low voltage line 62 connected to pin 7 and produces a local, regulated output of approximately five volts on pin 8, which is connected to rail 63. In one embodiment of the invention, driver circuit 61 was a 2845 pulse width modulator circuit. In FIG. 4, pin 1 of driver circuit 61 is indicated by a dot and the pins are numbered consecutively clockwise. The particular chip used to implement the invention included several capabilities which are not needed, i.e. the invention can be implemented with a much simpler integrated circuit such as a 555 timer chip.

Pin 1 of driver circuit 61 relates to an unneeded function and is tied high. Pins 2 and 3 relate to unneeded functions and are grounded. Pin 4 is the frequency setting input and is connected to an RC timing circuit including resistor 64 and capacitor 65. Pin 5 is electrical ground for driver circuit 61 and is connected to rail 68. Pin 6 of driver circuit 61 is the high frequency output and is coupled through capacitor 66 to inductor 67. Inductor 67 is magnetically coupled to inductor 78 and to inductor 79. As indicated by the small dots adjacent each inductor, inductors 78 and 79 are oppositely poled, thereby causing transistors $Q_9$ and $Q_{10}$ to switch alternately at a frequency determined by the RC timing circuit and the voltage on rail 63.

Resistor 71 and transistor $Q_6$ are series-connected between rails 63 and 68 and the junction between the resistor and transistor is connected to the RC timing circuit by diode 83. When transistor $Q_6$ is non-conducting, resistor 71 is connected in parallel with resistor 64 through diode 83. When resistor 71 is connected in parallel with resistor 64, the combined resistance is substantially less than the resistance of resistor 64 alone and the output frequency of driver circuit 61 is much higher than the resonant frequency of the LC circuit including inductor 98 and capacitor 99. When transistor $Q_6$ is saturated (fully conducting), diode 83 is reverse biased and the frequency of driver 61 is only slightly above the resonant frequency of the LC circuit, as determined by resistor 64 and capacitor 65 alone.

Driver 61 causes transistors $Q_9$ and $Q_{10}$ to conduct alternately under the control of inductors 78 and 79. The junction between transistors $Q_9$ and $Q_{10}$ is alternately connected to a high voltage rail, designated "+HV", and ground. The high voltage rail is driven by a converter.

The junction of transistors $Q_9$ and $Q_{10}$ is connected by line 81 through resistor 83 and capacitor 85 to ground. As transistors $Q_9$ and $Q_{10}$ alternately conduct, capacitor 85 is charged through resistor 83. Capacitor 85 and resistor 83 have a time constant of about one second. The bias network including resistors 83, 87, 89, and 91 causes the average voltage across capacitor 85 to be about five volts during normal operation of the ballast, even though the capacitor is charged from the high voltage rail which is at 300–400 volts.

The voltage on capacitor 85 represents a balance between the current into capacitor 85 through resistor 83 and the current out of capacitor 85 through resistors 87, 89 and 91 to ground. There is also some current to ground through the base-emitter junction of transistor $Q_6$. Transistor $Q_6$ is conductive but does not saturate and the transistor acts as a variable resistance between resistor 71 and ground. Resistor 97 pre-charges capacitor 85 to prevent a current spike in the lamp during start-up and has no effect on the circuit during normal operation.

The voltage on line 81 is proportional to the voltage from the converter. If the supply voltage from the converter should decrease, then the voltage on capacitor 85 decreases, and less current is available at the base of transistor $Q_6$. Transistor $Q_6$ does not switch on or off but operates in a linear mode as a variable resistance. With less current available at the base of transistor $Q_6$, the collector-emitter resistance increases thereby increasing the frequency of driver 61.

Transistor $Q_6$ is a low gain, inverting amplifier which inverts or reverses the sense of the change in line voltage, causing the frequency of the inverter to increase when the line voltage decreases and dimming lamp 73. The reduction in line voltage due to a brown-out is relatively small, e.g. no more than about ten percent, and the dimming of a lamp is barely perceptible. If one connects the ballast to a dimmer, then a lamp can be dimmed much more because transistor $Q_6$ is operated at very low current gain (a gain of 1–3), i.e. the input current must change considerably before transistor $Q_6$ saturates or shuts off. Because of the low gain, the rail voltage (+HV) can decrease approximately 100 volts to achieve full dimming.

In one embodiment of the invention, power to a fluorescent lamp was varied between 8 watts and 40 watts using a commercially available triac dimmer and the lamp remained lit throughout this range. Although a ballast constructed in accordance with the invention can work with a triac dimmer, a capacitive dimmer is preferred.

Overvoltage protection is provided by transistors $Q_7$ and $Q_8$ which are a complementary pair connected in SCR configuration. The current through transistor $Q_{10}$ is sensed by resistor 93. The current is converted to a voltage which is coupled by resistor 95 to the base of transistor $Q_7$, which acts as the gate of the SCR. When the voltage across resistor 93 reaches a predetermined level, transistors $Q_7$ and $Q_8$ are triggered into conduction, shorting the base of transistor $Q_6$ to ground and turning off transistor $Q_6$. When transistor $Q_6$ shuts off, the frequency of driver 61 is at a maximum, as described above. When transistor $Q_6$ shuts off, the frequency of driver 61 is sufficiently high for the voltage drop across resonant capacitor 99 to be insufficient to sustain lamp 73 and lamp 73 is extinguished.

Figure 5:
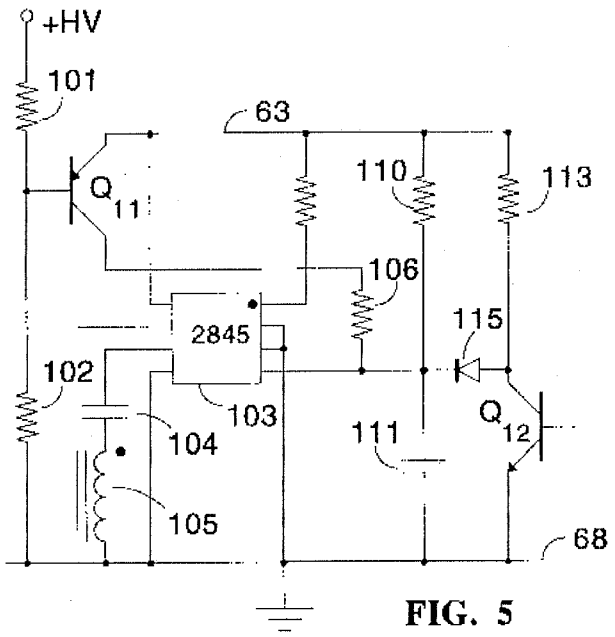
FIG. 5 illustrates an alternative embodiment of a driver circuit constructed in accordance with the invention.

FIG. 5 illustrates an alternative embodiment of the control portion of the inverter in which the linearly operated transistor is connected between the low voltage rail and the frequency control input of the driver circuit. A bias network including series connected resistors 101 and 102 is connected between the high voltage rail (not shown in FIG. 5) and ground rail 68 with the junction of the resistors connected to the base of transistor $Q_{11}$. Driver 103 produces high frequency pulses which are coupled through capacitor 104 and inductor 105 to the control electrodes of the half bridge switching transistors (not shown in FIG. 5). The operating frequency of driver 103 is determined primarily by series connected resistor 110 and capacitor 111.

Resistor 113 and transistor $Q_{12}$ are series-connected between low voltage rail 63 and ground rail 68 and the junction between the resistor and transistor is connected to the junction of resistor 110 and capacitor 111 by diode 115. Transistor $Q_{12}$ is slowly turned on for starting a lamp and, when transistor $Q_{12}$ is fully conducting, diode 115 is reverse biased to isolate resistor 113 from resistor 110. Transistor $Q_{11}$ and resistor 106 are series connected in parallel with resistor 110. Transistor $Q_{11}$ inverts variations in the voltage on the high voltage rail and the variation in the conductance of the transistor varies the frequency of driver 103 inversely with the variations of line voltage.

The frequency controls illustrated in FIGS. 4 and 5 are superficially similar but operate on different bases. The circuit shown in FIG. 5 is voltage sensitive and the circuit shown in FIG. 4 is current sensitive. Transistor $Q_{11}$ (FIG. 5) has a high gain since there are only small variations in the high voltage supply. Transistor $Q_6$ (FIG. 4) has low gain since small variations in supply voltage will cause large changes in current. The currents into and out of capacitor 85 are balanced and the operating point of transistor $Q_6$ is chosen such that transistor $Q_6$ is just conducting (maximum resistance) at minimum lamp brightness.

Output power is a non-linear function of rail voltage. The rail voltage can vary over a wide range, e.g. 250–350 volts, in the inverter of FIG. 4 and, within that range, there is a segment, e.g. 300–320 volts, in which the output power varies greatly for a small change in rail voltage. For the embodiment shown in FIG. 5, the entire operating range of the rail voltage is 300–320 volts and the output power varies from 20–100 percent within this range. Expressed as percentages, the variation in output power varies over a much wider range than the variations in rail voltage, e.g. a 10% decrease in rail voltage causes an 80% decrease in power from a ballast constructed in accordance with the invention.

Figure 6:
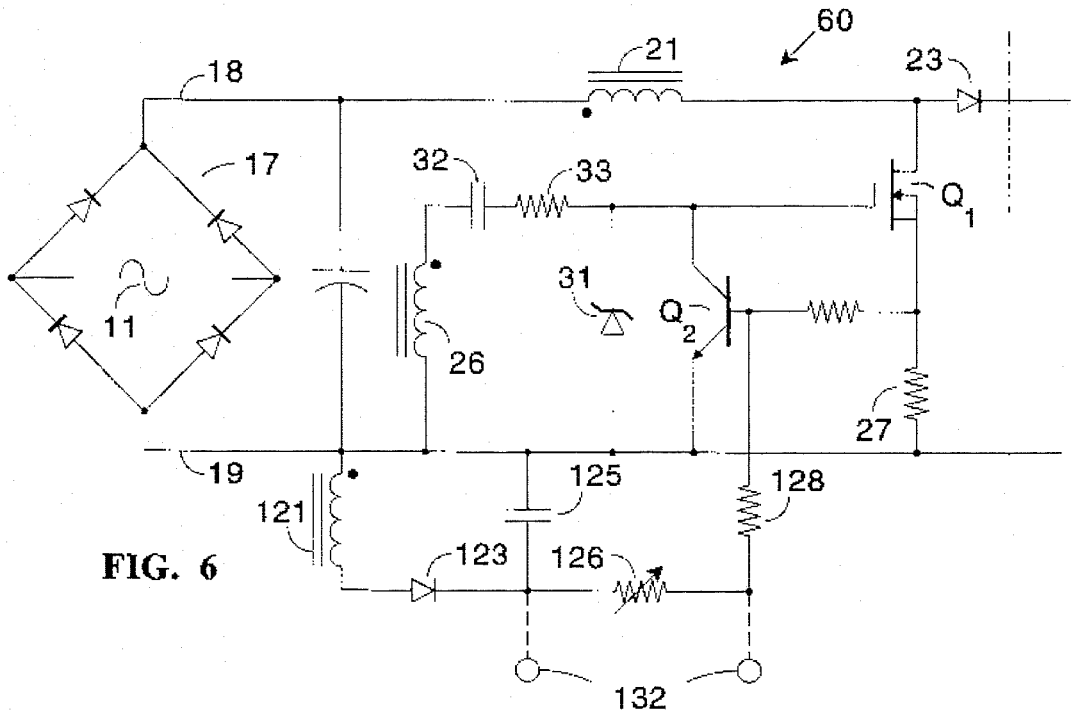
FIG. 6 is a schematic of a variable boost circuit for providing dimming in accordance with the invention.

FIG. 6 illustrates a converter constructed in accordance with a preferred embodiment of the invention in which the feedback to switching transistor $Q_1$ is modified to provide controllable dimming by adjusting the voltage supplied to inverter 54 (FIG. 2).

Inductor 121 is magnetically coupled to inductor 21 and inductor 26. The voltage induced in inductor 121 therefore includes a high frequency component from the operation of transistor $Q_1$ and a low frequency or ripple component from bridge 17. The voltage from inductor 121 is coupled to a ripple detector including diode 123 and capacitor 125. The rectified voltage on capacitor 125 is coupled to the control electrode of transistor $Q_2$ by potentiometer 126 and by resistor 128. Potentiometer 126 can be physically located inside or outside of the ballast.

Capacitor 125, potentiometer 126, and resistor 128 are an RC filter having a time constant on the order of the period of the ripple voltage from bridge rectifier 17. This is unlike circuits of the prior art wherein the time constant of the filter is much longer in order to filter out the ripple, i.e. the prior art provides DC feedback for controlling the current drawn by the boost circuit. Stated another way, inductor 121 provides low frequency feedback, i.e. feedback at the ripple frequency, for improving power factor.

During periods of high voltage from rectifier 17, a relatively lower voltage is produced on capacitor 125 which, in turn, decreases the conductivity of transistor $Q_2$ and increases the conductivity of transistor $Q_1$. During periods of low voltage, a higher voltage is coupled to the control electrode of transistor $Q_2$, increasing the conductivity of $Q_2$ and, in turn, reducing the conductivity of transistor $Q_1$.

It has been discovered that potentiometer 126 can be varied over a wide range, thereby reducing the output power of the inverter, without adversely affecting power factor or harmonic distortion if certain other adjustments are made to the ballast. Resistor 128 sets the minimum value of resistance. The component values in any ballast are a compromise among generally competing factors, such as output voltage, power factor, and stability under adverse conditions. In accordance with the invention, potentiometer 126 can be varied over a relatively wide range if the output voltage of the converter is adjusted upward slightly and the output frequency of the inverter is adjusted upward slightly.

Specific values depend upon the particular components in the remainder of the circuit and, therefore, the following values should be considered as examples only. A ballast constructed in accordance with FIG. 4 having a boost circuit as shown in FIG. 1 has an output frequency of about 25 khz. and a supply voltage of 300–320 volts (for a 120 volt AC input). Raising the voltage boost to maximum, or nearly to maximum, produces a supply voltage of about 460 volts (from a 120 volt AC input) for the inverter. The output frequency of the inverter is increased to reduce lamp current to a value previously corresponding to a supply voltage of 300–320 volts. With these adjustments, potentiometer 126 can vary by more than one order of magnitude, e.g. from 1kΩ to 50kΩ, and the output power to a lamp will vary from less than 20% to 100% of full power. Resistor 128 has a value of approximately 2.2kΩ. The ballast remains stable and is self-dimming when the AC line voltage is reduced. The voltage across a gas discharge lamp connected to the ballast remains stable, increasing slightly during dimming, and the current through the lamp decreases during dimming.

Figure 7:
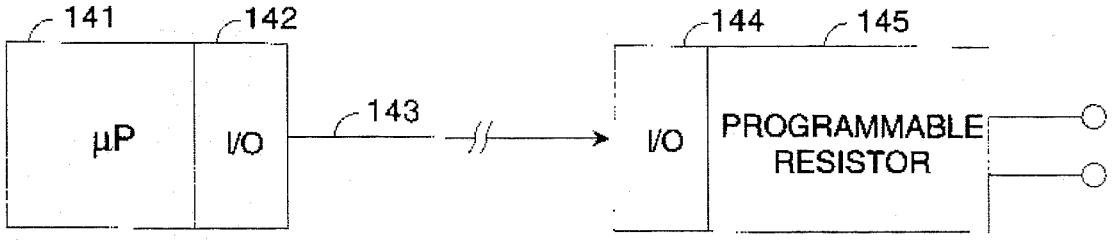
FIG. 7 is a block diagram of a remotely controlled lighting system.

Terminals 132 represent an alternative embodiment of the invention wherein a programmable resistor is substituted for potentiometer 126 for external control of dimming. FIG. 7 illustrates a suitable source of dimming signal for the boost circuit. Microprocessor 141 is coupled data line 143 by input/output circuit 142. Data from microprocessor 141 is received by input/output circuit 144 and converted into a suitable resistance by programmable resistor 145, which is coupled to terminals 132 (FIG. 6). An external sensor (not shown), responsive to the brightness of a room, could be included for closed loop control of brightness. I/O circuit 144 preferably includes opto-isolators (not shown) for protecting microprocessor 141 from high voltages in the ballast.

Figure 8:
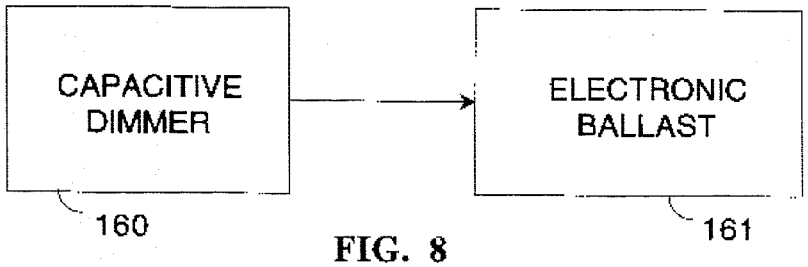
FIG. 8 is a block diagram of a dimming system constructed in accordance with the invention.

FIG. 8 illustrates the combination of a capacitive dimmer and a self-dimming ballast. Capacitive dimmer 160 is any commercially available dimmer which operates by turning on at the zero crossing of each half cycle of an AC line voltage. Ballast 161 is an electronic ballast constructed as described above. For ballasts having a converter and a variable frequency inverter with a series resonant, direct coupled output, the frequency of the inverter must increase with decreasing voltage from the converter. For ballasts having a converter and a pulse width modulated inverter with a series resonant, direct coupled output, the width of the pulses must decrease with decreasing voltage from the converter. The circuit shown in FIG. 4A of the above-identified Sullivan et al. patent can be modified to operate in accordance with this invention by coupling resistor 89 (FIG. 4 of this document) to pin 1 of IC1 (FIG. 4A of the Sullivan et al. patent).

The invention thus provides an electronic ballast which can be on the same branch circuit as incandescent lamps and controlled by a common dimmer, specifically a capacitive dimmer. Dimming occurs in response to the dimmer or in response to a decreased AC line voltage. Dimming can also be accomplished by varying the voltage supplied to an inverter, specifically by varying the boost voltage in the converter. The boost voltage can be varied mechanically, by a potentiometer, or electrically, by supplying an appropriate control signal, as shown.

Having thus described the invention, it will be apparent to those of skill in the art that various modifications can be made within the scope of the invention. For example, transformer coupling can be used instead of direct coupled outputs; e.g. substitute the primary of a transformer for inductor 98 and connect lamp 73 to the secondary of the transformer. A charge pump circuit can be used instead of a boost circuit.

What is claimed is:

1. An externally dimmable electronic ballast comprising:

a converter for converting low voltage alternating current into direct current at a high voltage;

an inverter coupled to said converter, said inverter supplying output power which can be varied over a wide range in response to small variations in said high voltage;

a series resonant, direct coupled output; and a control circuit coupled to said converter for increasing or decreasing said high voltage, thereby increasing or decreasing the power supplied by said inverter.

2. The ballast as set forth in claim 1 wherein said inverter produces a high voltage at high frequency from said direct current and wherein said high frequency increases when said high voltage decreases and said high frequency decreases when said high voltage increases.

3. The ballast as set forth in claim 1 wherein said inverter produces high frequency pulses from said direct current, wherein said pulses increase in width when said high voltage increases and decrease in width when said high voltage decreases.

4. The ballast as set forth in claim 1 wherein said converter includes a full wave rectifier for producing a first voltage and a boost circuit for producing a second voltage, wherein said converter combines said first voltage and said second voltage to produce said high voltage, and wherein said high voltage is increased or decreased by varying said second voltage.

5. The ballast as set forth in claim 4 wherein said boost circuit includes a potentiometer for increasing or decreasing said second voltage.

6. The ballast as set forth in claim 4 wherein said boost circuit includes a control input for receiving a control signal to increase or to decrease said second voltage.

7. A lighting system for providing reduced power from controlled dimming, said lighting system comprising:

a capacitive dimmer producing an adjustable output voltage; and a ballast powered by said dimmer, said ballast characterized by an output power which can be varied over a range of from less than 50 percent to 100 percent of full power in response to said adjustable output voltage.

8. The lighting system as set forth in claim 7 wherein said ballast includes a series resonant, direct coupled output and said ballast includes an inverter having an inversion frequency inversely related to said adjustable output voltage.

9. The lighting system as set forth in claim 7 wherein said ballast includes a half-bridge inverter and a series resonant inductor and capacitor and wherein said inverter produces pulses having a width directly related to said adjustable output voltage.

* * * * *